United States Patent [19]

Criscitelli

[11] 4,210,236

[45] Jul. 1, 1980

[54] STAMP BOOK VENDING MACHINE

[75] Inventor: Fred J. Criscitelli, Hawthorne, N.J.

[73] Assignee: United States Postage Corporation, Wayne, N.J.

[21] Appl. No.: 880,715

[22] Filed: Feb. 22, 1978

[51] Int. Cl.[2] ..... G07F 9/04

[52] U.S. Cl. ..... 194/1 D

[58] Field of Search ..... 221/7, 273; 194/10, 194/DIG. 3, 1 M, 1 L, 1 D, 39

[56] References Cited

U.S. PATENT DOCUMENTS

| | | | |
|---|---|---|---|
| 2,973,075 | 2/1961 | Grenier et al. | 194/10 |
| 3,156,340 | 11/1964 | Arkes | 194/10 |
| 3,372,785 | 3/1968 | Bei et al. | 194/10 |
| 3,442,200 | 5/1969 | Babel | 221/273 |

*Primary Examiner*—Stanley H. Tollberg

*Attorney, Agent, or Firm*—Le Blanc, Nolan, Shur & Nies

[57] ABSTRACT

A stamp book vending machine wherein a motor driven slidable plate extracts a book from the bottom of a vertical stack and at the same time actuates a counter and discharges accumulated coins into a collection box, an independent arrangement being provided for selectively discharging accumulated coins into an externally open coin return pocket without dispensing a stamp book.

9 Claims, 4 Drawing Figures

STAMP BOOK VENDING MACHINE

This invention relates to coin controlled vending machines and particularly to such machines for dispensing postage and like stamps in so-called book form.

Postage stamps may be purchased in bulk at a Post Office in sheet, roll or book form. The sale of postage stamps represents man hours spent in activity that does not contribute to handling mail, so that it is desirable to reduce the number of personnel involved in handling stamps. For that reason postage stamp vending machines have been proposed and are in use in various Post Offices.

The present invention deals with the coin controlled dispensing of stamps in book form. The Post Office today sells books each consisting of two pages totalling twenty-three stamps bound between stiff covers, thus providing a thin flat stiff stamp book about 3¼ inches long and 1½ inches wide. The term stamp book as used hereinafter refers to such, although the number of stamps and or the dimensions may be different in accord with Post Office practice.

The term coin includes tokens and other legal check devices used in place of actual coins. A stack of stamp books is a number of horizontal stamp books one above the other in a vertical chute.

In the invention the stamp books are confined in a vertical stack in the chute, and coin controlled mechanism is actuated to extract one book at a time from the bottom of the stack and deliver it to the purchaser, and this is the major object.

A further object of the invention is to provide a novel slide and slide operating arrangement, the slide coacting with a space at the lower end of a chute containing a vertical stack of stamp books and coin controlled actuating means for moving the slide for extracting a book of stamps from that space.

Another object of the invention is to provide a stamp book vending machine having novel coin return arrangements.

A further object of the invention is to provide a novel stamp book vending machine having novel means for dispensing a stamp book correlated with counter and coin handling arrangements.

Further objects of this invention will become apparent from the following detailed description, discussion and the appended claims taken in conjunction with the accompanying drawings.

PREFERRED EMBODIMENT

Figure 1:
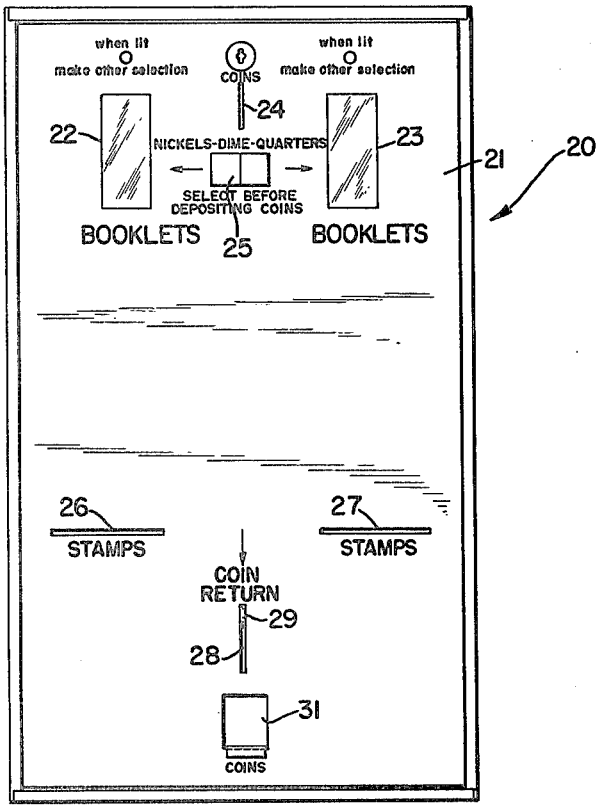
FIG. 1 is a front view of a stamp book vending machine.

Referring to FIG. 1 the stamp book vending machine comprises a cabinet 20 enclosing the stamp book supply and the mechanism for handling the coins and selectively dispensing the stamp books. The machine here depicted contains in its front panel 21 two vertical chutes associated with display windows 22 and 23 that indicate the value of the stamp books in the particular stack. Where only one value stamp book is obtainable, the stacks may be duplicates, but where two different value stamp books are available they may be separated into the respective stacks.

As will appear individual practically identical stamp book extraction arrangements are provided for each stack. A single coin slot 24 is provided, and adjacent the slot is a switch 25 for selecting the stack from which a stamp book is to be extracted.

The dispensed stamp books exit through narrow horizontal slots 26 and 27 in the front panel. The front panel also contains a slot 28 through which extends the end of a rockable coin return lever 29. A coin return pocket 31 is open through the panel just below lever 29.

Figure 2:
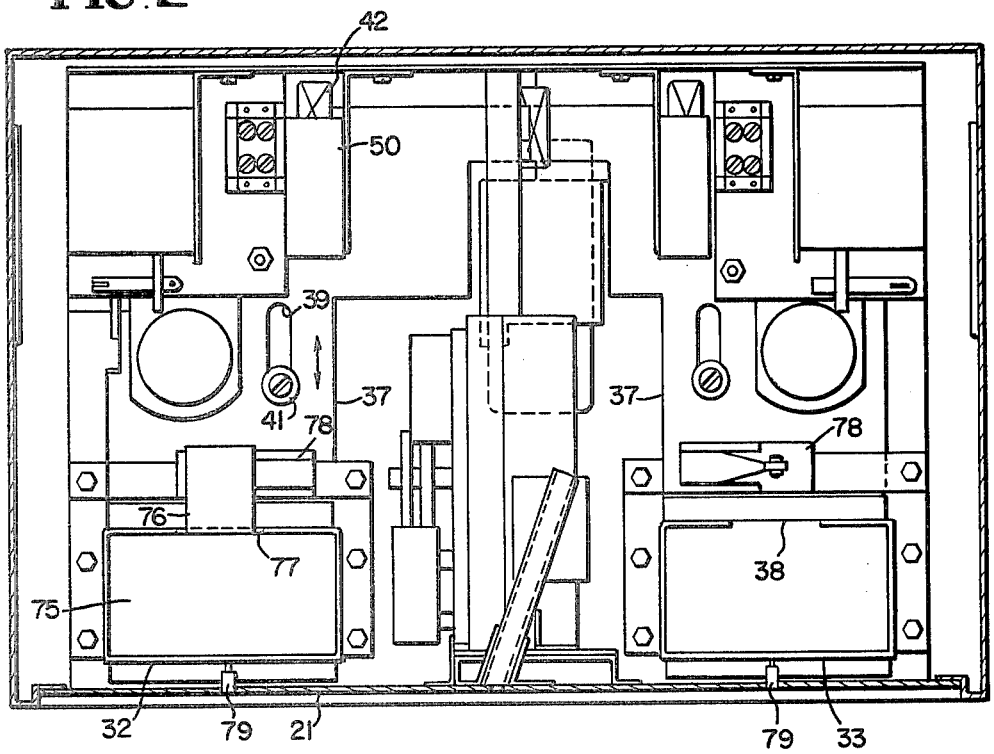
FIG. 2 is a top plan view partly in section showing two stacks of stamp books and detail within the cabinet.
Figure 3:
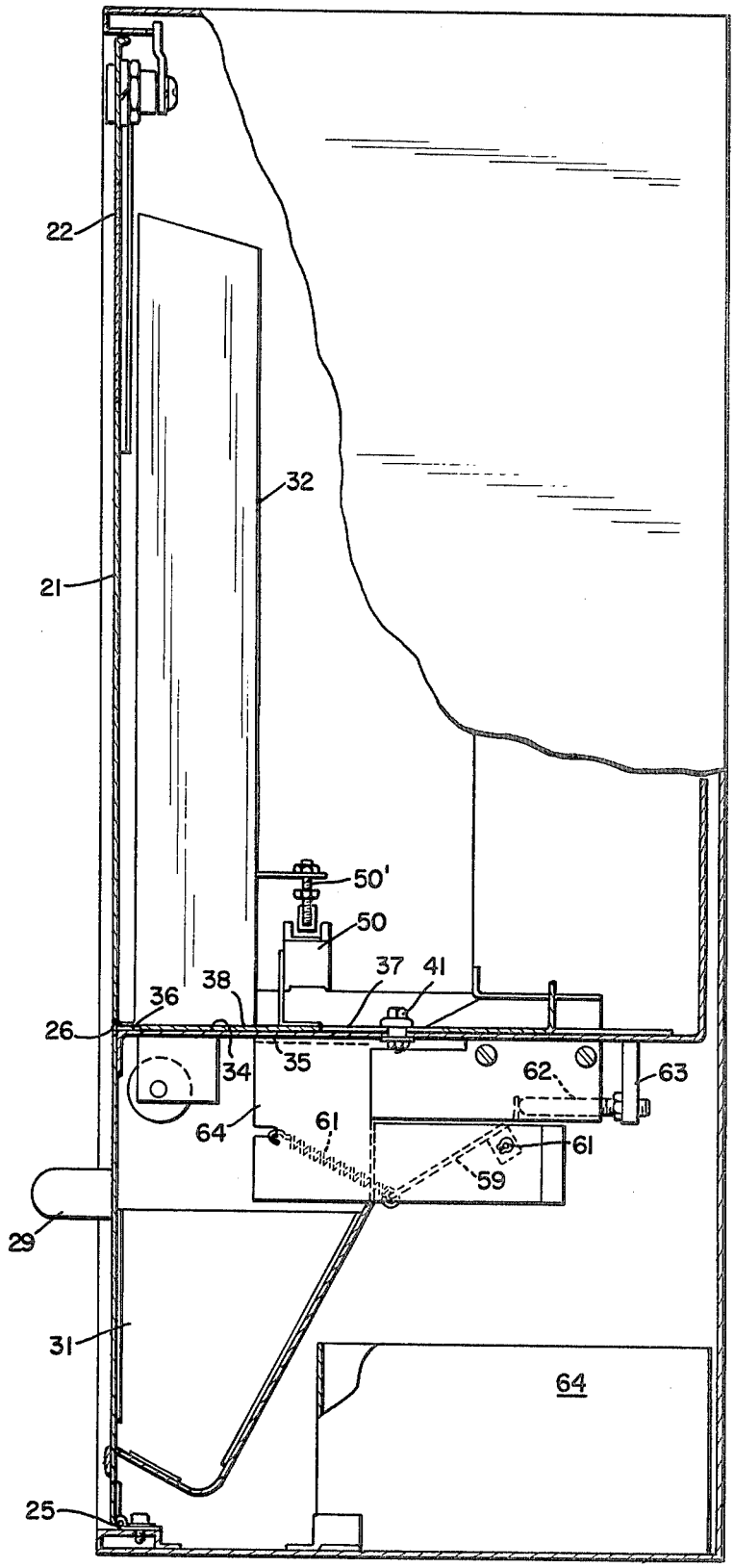
FIG. 3 is a side elevation partly broken away and in section showing slide action, coin handling and further detail within the cabinet.

As shown in FIG. 2, the cabinet contains two side by side open top and bottom chutes 32 and 33 each of such uniform cross sectional size as to contain a stack of horizontal stamp books with sufficient freedom that the stack freely slidably lowers itself as a book is extracted from the bottom. These chutes are substantial duplicates, and one chute 32 is shown in FIG. 3. The stacks of stamp books are loaded through the upper open ends of the chutes.

Chute 32 as shown in FIG. 3 terminates at its lower end just above the flat smooth horizontal surface 34 of a fixed table 35 to provide a narrow space 36 of such vertical dimension as to contain only one stamp book representing the lowermost stamp book in the stack, the front edge of this space being opposite exit slot 26.

Thus when the machine is ready for operation the vertical stack in each chute is supported on a horizontal table surface, with the lowermost stamp book free of the chute.

A slide plate 37 is suitably supported for horizontal sliding movement in alignment with each space 36. Plate 37 is preferably a flat sheet metal element of substantially the thickness of a stamp book with at least its straight front edge 38 extending over table surface 34, so that when displaced to the left in FIG. 3 it will engage and displace the stamp book in space 36 to project through opening 26. The book need be displaced only enough to enable the customer to grasp its leading end at opening 26. Preferably plate 37 is slotted as at 39 to receive one or guide pins 41 for directional control of sliding movement. A spring 40 is connected to slide 37 to bias the slide to the right in FIG. 3 away from space 36 to locate slide edge 38 initially out of contact with the stamp book on the table surface.

Figure 4:
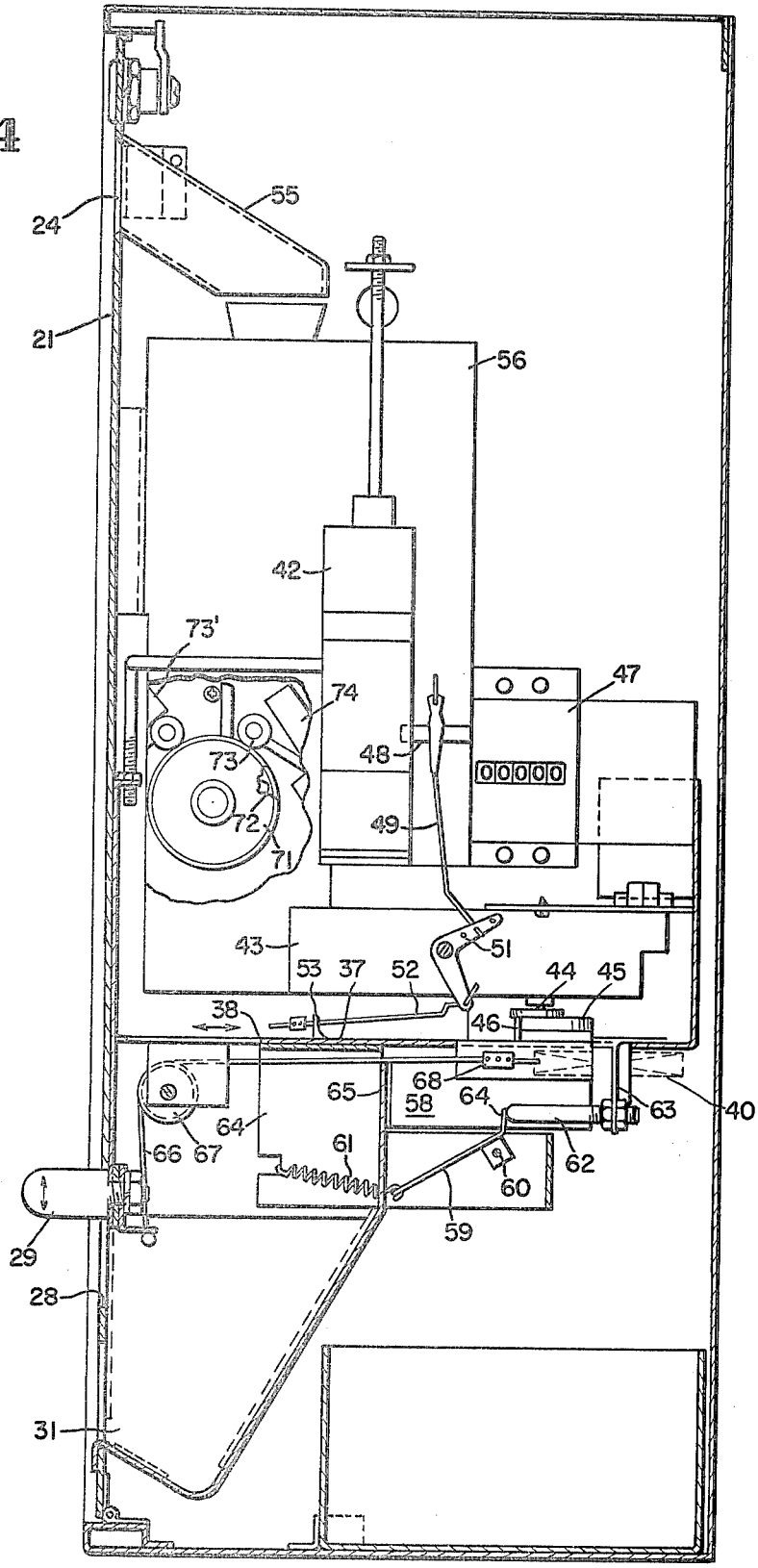
FIG. 4 is a side elevation partly in section further showing slide actuation and coin handling in the machine.

Referring to FIG. 4 an electric motor 42 has its shaft connected through a reduction gear box 43 to drive an output shaft 44 on which is mounted a slide operating cam 45 that abuts a lip 46 fixed on the upper side of slide plate 37. Thus when motor 42 is energized to rotate cam 45 the slide plate 37 will be displaced to the left in FIG. 4 to accomplish the above described stamp book displacement through slot 26. Motor 42, during each book dispensing operation, is energized only long enough for cam 45 to make a single revolution, and spring 40 will return plate 37 to its initial position. As the slide plate 37 returns to initial position it operates a microswitch 50 in the circuit of motor 42 to deenergize the circuit and ensure that the energization of motor 42 at each dispensing operation is limited to one book extracting advance of slide 37. Switch 50 may be carried by plate 37 and coact with a fixed abutment 50′ as shown.

A digital irreversible counter 47 externally visible through a panel window of the cabinet side has an actuating lever 48 connected through cable 49, bellcrank 51 and cable 52 to a projection 53 fixed on slide 37, so that each time the slide 37 moves to displace a stamp book through the exit slot 26 the counter records the same.

The same slide plate, motor and counter arrangements are provided at the other stack.

The coins for effecting operation of the vending machine are inserted in the form of quarters, dimes and nickels to travel down chute 55 into a coin selection or rejection device indicated at 56 which may take any suitable form and the details of which per se do not comprise part of the present invention. In any event should the device 56 accept the coins they drop therethrough into the coin receiving compartment 58 which has a bottom coin release door 59 pivoted at 60 and spring biased closed by spring 61.

When a slide plate 37 moves from right to left in FIG. 4 to eject a stamp book and operate counter 47, it also automatically acts through a pin 62 mounted on tab 63 depending from the plate and engaging an upstanding tab 64 on the release door to tilt the release door counterclockwise to dump the accumulated coins into the final collection box 64.

The device 56 will direct rejected coins, slugs and the like into the coin return pocket 31.

In the event that coin return from compartment 58 is required, as when the customer deposits a few coins and then changes his mind, means is provided for dumping any coins in compartment 58 into the return pocket 31.

The side wall closure 65 of compartment 58 is slidably mounted in the machine for horizontal movement toward or away from front panel 21. The return lever 29 is suitably connected by a cable 66 running over pulley 67 to a lug 68 fixed to wall 65, whereby as lever 29 moves down the wall 65 is displaced to the left thereby widening the opening at the lower end of door 59, so that the coins on inclined wall 59 fall by gravity into pocket 31. Other mechanical arrangements for selectively opening a side wall aperture for compartment 58 may be provided such as a means for sliding wall 65 normal to the plane of the paper in FIG. 4, and it will be understood that the illustrated mechanism is by way of example only.

With further reference to FIG. 4 a rotatable switch cam 71 has a surface notch 72 adapted to receive a roller 73 on the actuating arm of a microswitch 74 in the circuit of motor 42. The coin selection device indexes cam 71 in the conventional manner until when the proper value in coins has been deposited and accepted roller 73 falls into notch 72 and closes switch 74 to operate motor 42 for one revolution of cam 45. When lever 29 is actuated to discharge coins into pocket 31, it acts through an operative connection to the mechanism that indexes cam 71 in response to coin deposit through device 56 to reset the cam to initial position.

Referring to the left chute 32 in FIG. 2, a weight 75 rests on the top of the stack of stamp books and an arm 76 extends through a vertically elongated slot 77 in the chute wall. A microswitch 78 in circuit with a lamp 79 in the front panel is mounted just above slide plate 37, so that as the supply of books in the stack becomes exhausted the arm 76 moves closer to switch 78 until, when only one or two books remain in the stack, arm 76 closes switch 78 and this lights lamp 79 to indicate to the operator that he should operate switch 25 to select the other chute for dispensing.

The power for operating motor 42 may be derived from a built-in rechargeable power pack such as is indicated at 70 in FIG. 4. This power pack may be recharged or replaced during the regular servicing or stamp book refill periods.

Referring to FIG. 4 it will be noted that a cam operated second microswitch 73' may be operated by a second cam behind cam 71. This second cam is similarly notched and operates to control the operation of the separate motor and ejector slide plate for the other stack, as selected by switch 25.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description, and all changes which come within the meaning and range of equivalency of the claims are therefore intended to be embraced therein.

What is claimed and desired to be secured by Letters Patent is:

1. In a machine for vending stamp books, means providing a vertical stack of horizontally disposed separate stamp books and disposing the bottom book of the stack in a space having a dimension longitudinally of the stack approximately equal to the thickness of one book, means providing a horizontally slidable stamp book ejector plate reciprocable in a plane aligned with and parallel to said bottom book, means for reciprocating said ejector plate to displace the bottom book out of the stack comprising an electric motor driven cam operably connected to said plate, coin controlled means for actuating said ejector plate comprising means whereby upon deposit of a coin or coins of predetermined value said motor will be actuated to operate said cam through a single complete cycle during which said plate moves through said space to eject the bottom book and then returns to initial position, said stack then lowering to dispose the lowermost book in said space, and a coin receiving compartment for accepting said deposit of a coin or coins sufficient to effect a cycle of operation of said motor cam and ejector plate, a movably mounted normally closed coin release door for said compartment, a coin collection box below said compartment, and means movable with said ejector plate and adapted for operative connection to said release door whereby book ejection movement of the slide plate opens said door to transfer coins from said compartment into said collection box.

2. In the machine defined in claim 1, said stack providing means comprising a vertical chute and the bottom book of the stack resting on a smooth horizontal surface located to provide said space at the lower end of said chute.

3. In the machine defined in claim 1, said motor having an operating circuit containing a normally open switch, and said coin controlled means comprising a cam actuated by deposited coins to close said switch when the predetermined coin value is deposited.

4. In the machine defined in claim 1, means providing a coin return pocket accessible from outside the machine, means defining a coin compartment within the machine for collecting deposited coins, and means operable independently of said ejector for discharging coins from said compartment into said return pocket.

5. In the machine defined in claim 1, spring means biasing said plate toward said initial position, said cam being operable to energize said spring when moving said plate for stamp book ejection.

6. In a machine for vending stamp books, means providing a vertical stack of horizontally disposed separate stamp books and disposing the bottom book of the stack in a space having a dimension longitudinally of the stack approximately equal to the thickness of one book, means providing a horizontally slidable stamp book ejector reciprocable in a plane aligned with and parallel to said bottom book, means for reciprocating said ejector to displace the bottom book out of the stack, coin controlled means for actuating said ejector means, means providing a coin receiving compartment having a movable discharge door, and means for operatively connecting said ejector and door whereby stamp book displacing movement of said ejector also opens said door to discharge coins from the compartment.

7. In the machine defined in claim 6, a counter visible externally of said machine and an operative connection between the ejector and counter whereby the counter is actuated each time a stamp book is dispensed.

8. In the machine defined in claim 6, said ejector being a horizontally reciprocable slide plate, and said door being a pivoted member spring biased closed and having means engageable by cooperating means on said plate for tilting the door open when the plate is extracting the bottom stamp book from the stack.

9. In a machine for vending stamp books, means providing a vertical stack of horizontally disposed separate stamp books and disposing the bottom book of the stack in a space having a dimension longitudinally of the stack approximately equal to the thickness of one book, means providing a horizontally slidable stamp book ejector reciprocable in a plane aligned with and parallel to said bottom book, means for reciprocating said ejector to displace the bottom book out of the stack, coin controlled means for actuating said ejector means, means providing a coin return pocket accessible from outside the machine, means defining a coin compartment within the machine for collecting deposited coins, and means operable independently of said ejector for discharging coins from said compartment into said return pocket, said last named means comprising a manual operating lever connected to open a discharge door of said compartment.

* * * * *